US005859403A

United States Patent [19]

Zigliotto

[11] Patent Number: 5,859,403

[45] Date of Patent: Jan. 12, 1999

[54] PLASMA TORCH WITHOUT HIGH-FREQUENCY IGNITION, WITH IMPROVED ELECTRODE AIR-COOLING DEVICES

[75] Inventor: Giuseppe Zigliotto, Vicenza, Italy

[73] Assignee: Trafimet S.P.A., Vicenza, Italy

[21] Appl. No.: 893,678

[22] Filed: Jul. 11, 1997

[30] Foreign Application Priority Data

Jul. 18, 1996 [IT] Italy ..... VI960060 U

[51] Int. Cl.[6] ..... B23K 10/00

[52] U.S. Cl. ..... 219/121.52; 219/121.51; 219/121.49; 219/75

[58] Field of Search ..... 219/121.49, 121.52, 219/121.36, 121.48, 121.51, 75, 119, 74, 118; 313/231.31, 231.41

[56] References Cited

U.S. PATENT DOCUMENTS

| | | | |
|---|---|---|---|
| 3,242,305 | 3/1966 | Kane et al. | 219/75 |
| 3,450,926 | 6/1969 | Kiernan | 219/121.49 |
| 4,788,408 | 11/1988 | Wlodarczyk | 219/121.49 |
| 4,973,816 | 11/1990 | Haberman | 219/121.48 |
| 5,164,569 | 11/1992 | Porra et al. . | |
| 5,416,296 | 5/1995 | Walters | 219/121.5 |

FOREIGN PATENT DOCUMENTS 0591018 4/1994 European Pat. Off. .

*Primary Examiner*—Mark H. Paschall
*Attorney, Agent, or Firm*—Watson Cole Grindle Watson, P.L.L.C.

[57] ABSTRACT

This invention relates to a plasma torch with electrode air-cooling devices, comprising:

a hollow electrode systems designed to introduce cooling air into the electrode near the tip, which systems consist of a tubular element smaller than the hole in the electrode so as to form a cavity between the inner wall of the electrode and the tubular element passages designed to place the top of the electrode in communication with a ring-shaped chamber inside the torch body which surrounds the electrode passages situated in the torch body which are designed to place the said ring-shaped chamber in communication with the area surrounding the hood passages designed to place the said ring-shaped chamber in communication with the plasma chamber.

10 Claims, 1 Drawing Sheet

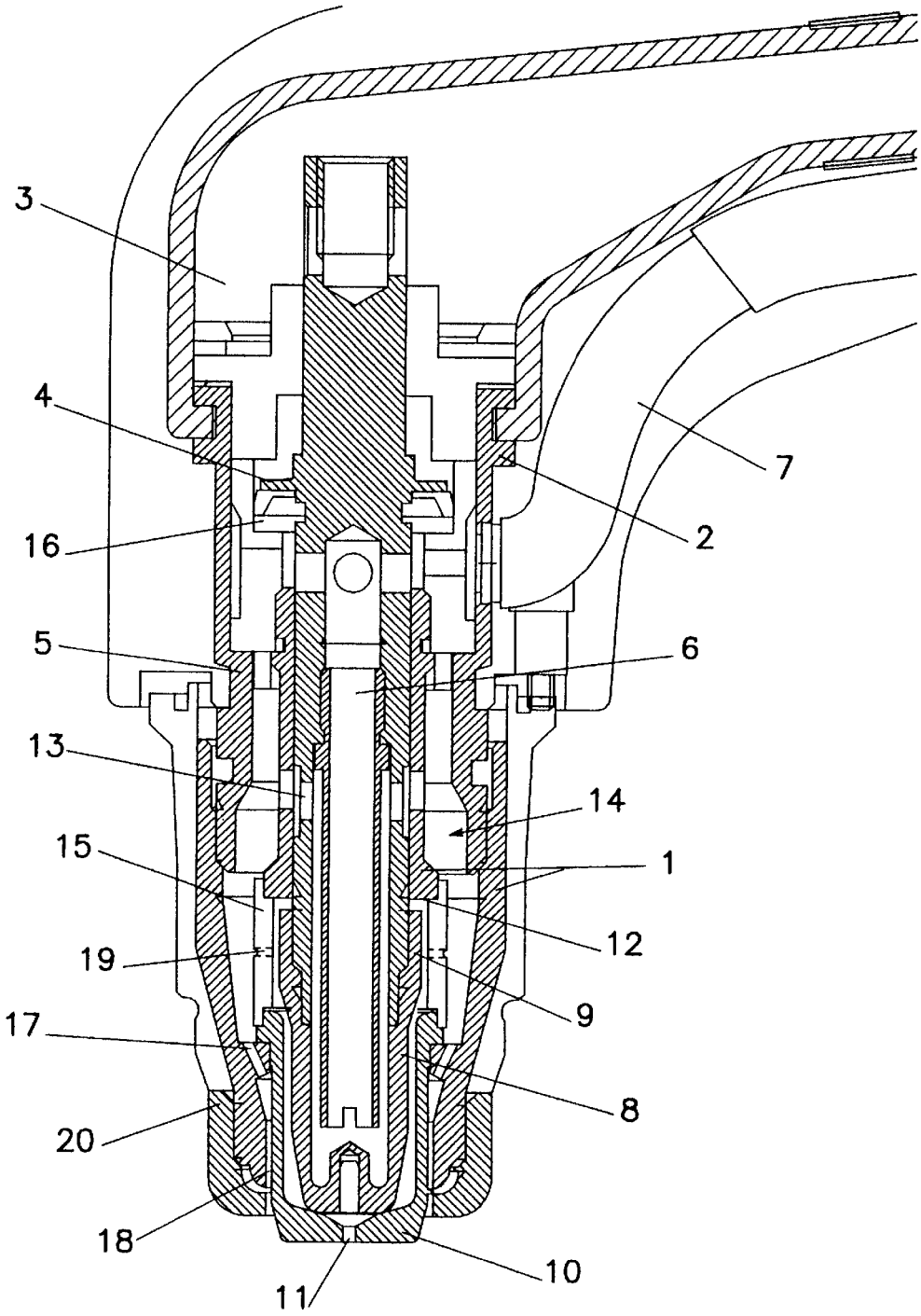
3
4
16
5
13
15
19
17
20
18
11
10
8
9
12
1
14
6
2
7

PLASMA TORCH WITHOUT HIGH-FREQUENCY IGNITION, WITH IMPROVED ELECTRODE AIR-COOLING DEVICES

BACKGROUND OF THE INVENTION

This invention relates to a plasma torch of the type in which the electrode and the hood are brought into contact with one another to ignite the arc, and which features improved electrode air-cooling devices.

In the open position the electrode comes to rest against the torch body, thus determining the extent of its travel and therefore its working position.

In particular, in the torch in accordance with the invention, the electrode is hollow and contains a tube which directs a jet of pressurised air towards the tip of the electrode to cool it.

The same air is then directly partly towards the outer surface of the hood to complete cooling, and partly towards the plasma chamber for cutting.

As a result of the special configuration of the parts, a torch can be made which is highly compact but still guarantees precision of movement and efficient cooling of the various components, especially at the tip of the electrode where heating is greatest.

Plasma torches in which the electrode is air-cooled are already known; these are mainly low-powered torches.

In these known torches, a quantity of air is sent to the plasma chamber for cutting, and the same air is also used to cool the outside of the electrode.

This is a system of limited efficacy, because the amount of air used for cutting is small (approx. 10–20 l/min.) and only the outside of the electrode is cooled.

Higher-powered plasma torches are also known in which cooling is effected by circulation of a flow of water conveyed inside and outside the electrode.

As a result of French patent 2669846 by the same applicant, a plasma torch is also known in which an electrode is fitted to a support piston so as to constitute an assembly which moves inside the torch from a position in which the electrode rests against the wall of the plasma chamber to a working position in which the piston retracts, raising the electrode and moving it to a pre-set distance from the wall of the chamber.

This type of torch presents two drawbacks.

Since the piston moves to the end of its travel in the electrode raised position (in the case in point until it comes into contact with the upper wall of the cylinder) and the working position of the electrode is therefore determined by that of the piston, it follows that if the electrode is to be positioned at a specific working height (a characteristic which is crucial to the correct operation of the torch), it must be fitted with equal precision to the piston, with all the difficulties that involves.

DESCRIPTION OF THE RELATED ART

Equally, in view of the small size of the various components, it is difficult to make a hollow electrode with a diameter of a few millimetres in order to increase the efficiency of cooling.

SUMMARY OF THE INVENTION

This invention presents an improved type of plasma torch which is air-cooled in such a way as to achieve complete, effective cooling of the whole electrode.

For this purpose the electrode in accordance with the invention is hollow, with an internally threaded flange at its base so that it can be screwed to the rod of a supporting piston; the said flange forms a ring-shaped shoulder that comes to rest against the body of the torch and thus constitutes a stop which precisely determines the positioning height of the electrode in the raised position, regardless of the precision with which the electrode is fitted to the piston.

This configuration also facilitates the construction of the hollow electrode, enabling a jet of cooling air to be directed to its interior and then conveyed outside the electrode and divided into a first flow that continues cooling and a second flow conveyed to the plasma chamber for cutting.

BRIEF DESCRIPTION OF THE DRAWING

This invention will now be described in detail, by way of example but not of limitation, by reference to the single figure annexed which shows a cross-section of a plasma torch in accordance with the invention. In the figure, no. 1 indicates the torch body, fitted to a connector 2 which in turn is fixed to a handgrip 3.

DESCRIPTION OF THE INVENTION

Body 1 contains a chamber 16 inside which a piston 4 moves; the said piston is integral with a hollow rod 5, inside which a tube 6 is fitted axially; the said tube is connected via a union 7 to pressurised air or gas supply devices not illustrated.

Rod 5 can therefore slide axially inside the torch driven by piston 4; the said piston is activated by the same pressurised air, which is conveyed from union 7 into the chamber of piston 4, raises it and then flows into tube 6 in rod 5.

An electrode 8, also hollow, is fitted in the torch; at the base of electrode 8 there is an internally threaded flange 9 screwed to the bottom end of rod 5, which is also threaded.

A hood 10 made of conductive material is fitted at the tip of body 1; the said hood surrounds the tip of the electrode and contains a hole 11 through which gas flows at the tip.

A chamber called the "plasma chamber" is therefore created in the area between electrode 8 and hood 10.

The electrode is normally in contact with the inner wall of hood 10. The arc is formed between the electrode and the wall of the hood when the electrode is raised by piston 4.

In accordance with one aspect of the invention, flange 9 which constitutes the base of the electrode forms a shoulder which comes to rest against surface 12 in the body of the torch when the electrode is raised, and thus constitutes a retainer or stop device which determines the exact position of the electrode during cutting.

The position of the electrode is therefore not determined by the travel of piston 4, thus eliminating the need for extremely precise fitting of the electrode to its support.

A nozzle 20 encloses the entire assembly, from the bottom of which the end of the hood protrudes.

In accordance with the invention electrode 8 is hollow, and tubular element 6 reaches almost to the tip of the electrode.

The outer diameter of tubular element 6 is smaller than the inner diameter of the electrode, so that a cavity is left between tube 6 and electrode 8 for the flow of air.

The air conveyed from tube 6 is directed against the tip of the electrode from the inside, then rises up the cavity.

A number of holes 13 are drilled in the upper part of rod 5 so that air can exit from the cavity and flow towards chamber 14, between torch body 1 and the electrode.

Here, hood 10 is fitted to the electrode with the interposition of a union 15 which contains a number of small holes 19 that place chamber 14 in communication with the area between hood 10 and electrode 8, where the electrical arc is formed.

Torch body 1 contains a number of holes 17 which enable chamber 14 to communicate with a cavity 18 between the torch body and the outer surface of hood 10.

The cooling air conveyed from union 7 passes from the inside of the electrode through holes 13 to chamber 14, where it is divided into two flows.

The main flow through holes 17 is directed to cavity 18 and cools hood 10, while part of the flow is conveyed through holes 19 in union 15 to the plasma chamber to assist with cutting.

This system produces efficient cooling of the electrode because a coolant fluid can be conveyed along almost its entire surface, both from inside and from outside.

In addition the same air flow is used for both cutting and cooling, thus eliminating the need for separate devices to convey cutting and cooling air. It is thus possible to make a highly compact torch with an efficient cooling system which limits wear and tear on the various components.

The size and the materials employed can obviously vary, depending on the required use.

I claim:

1. A plasma torch comprising:

a body having an axial internal cavity for receiving cooling air and having a reference surface therein;

a piston having a free end and being axially movable within the cavity between a lowered position and a raised working position upon selective application of air pressure;

a hollow electrode having an proximal end secured to the free end of the piston and movable therewith, said electrode having a free end for contacting the body when the piston is in the lowered position and being movable with the piston into precise spaced relation with the body in the working position, the proximal end of the electrode having a corresponding surface for directly engaging the reference surface within the cavity when the electrode is moved to the working position for establishing the precise spacing between the free end of the electrode and the body.

2. A plasma torch in accordance with claim 1 wherein the body has a distal end and includes a hood located therein surrounding a portion of the distal end of the electrode for establishing a plasma chamber therebetween.

3. A plasma torch in accordance with claim 2 wherein the hood has an opening at the distal end forming a downstream outlet in the plasma chamber.

4. A plasma torch in accordance with claim 3 wherein the hood has an inlet opening upstream of the outlet in the plasma chamber.

5. A plasma torch in accordance with claim 2 wherein a portion of the body surrounds a proximal end of the hood forming a cooling cavity therebetween.

6. A plasma torch in accordance with claim 5 wherein the body electrode has a proximal end and the body has upstream openings near the proximal end of the hood in communication with the cooling chamber and downstream openings for communicating with cooling chamber and forming a cooling passage between said upstream and downstream openings.

7. A plasma torch in accordance with claim 1 wherein the torch includes a union and a hood secured thereto forming a plasma chamber surrounding the electrode, and said hood has holes for communicating with in flow communication in the chamber.

8. A plasma torch in accordance with claim 1 wherein said tubular element has an inlet for communicating pressurized air into the electrode.

9. A plasma torch in accordance with claim 8 wherein the torch has a handgrip and the electrode is connected to a pressurized air supply pipe formed in said handgrip.

10. A plasma torch in accordance with claim 1 wherein piston and the electrode establish separate cooling and plasma chambers and interconnecting passages.

* * * * *

UNITED STATES PATENT AND TRADEMARK OFFICE

CERTIFICATE OF CORRECTION

PATENT NO. : 5,859,403
DATED : January 12, 1999
INVENTOR(S) : Giuseppe Zigliotto It is certified that error appears in the above-identified patent and that said Letters Patent is hereby corrected as shown below:

Item [73],
Assignee: Trafimet S.P.A. Casteguero, Vicenza, Italy

Signed and Sealed this

Twenty-third Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 5,859,403
DATED : January 12, 1999
INVENTOR(S) : Giuseppe Zigliotto It is certified that error appears in the above-identified patent and that said Letters Patent is hereby corrected as shown below:

Title page,
Item [73], Assignee should read as follows:

-- [73] Assignee: Trafimet S.P.A. Castegnero, Vicenza, ITALY --

This certificate supersedes Certificate of Correction issued on October 23, 2001.

Signed and Sealed this

Twenty-eighth Day of May, 2002

*Attest:*

*Attesting Officer*

JAMES E. ROGAN
*Director of the United States Patent and Trademark Office*